United States Patent [19]

Ishii et al.

[11] 4,081,883

[45] Apr. 4, 1978

[54] LOCKING SLIDER FOR SLIDING CLASP FASTENERS

[75] Inventors: Susumu Ishii; Tuneo Suzuki, both of Kurobe, Japan

[73] Assignee: Yoshida Kogyo K.K., Japan

[21] Appl. No.: 777,950

[22] Filed: Mar. 16, 1977

[30] Foreign Application Priority Data

Mar. 19, 1976 Japan ..... 51-33227[U]

[51] Int. Cl.[2] ..... A44B 19/30
[52] U.S. Cl. ..... 24/205.14 R
[58] Field of Search ..... 24/205.14 R

[56] References Cited

U.S. PATENT DOCUMENTS

| | | | |
|---|---|---|---|
| 2,373,523 | 4/1945 | Winterhalter | 24/205.14 R |
| 2,654,931 | 10/1953 | Voity | 24/205.14 R |

*Primary Examiner*—Bernard A. Gelak
*Attorney, Agent, or Firm*—Bucknam and Archer

[57] ABSTRACT

A locking slider for sliding clasp fasteners is provided with a locking spring member for locking the slider into position on the fastener. The locking spring member is formed from a strip of stainless steel into a desired shape, the strip having an area higher in the cold rolling modulus than the remaining areas, such that the resiliency inter alia of the formed locking member is increased to an extent sufficient to withstand severe external stresses.

2 Claims, 5 Drawing Figures

LOCKING SLIDER FOR SLIDING CLASP FASTENERS

BACKGROUND OF THE INVENTION

1. Field of the Invention

This invention relates to sliders for sliding clasp fasteners or zippers and has particular reference to an automatic locking slider of the type which generally comprises a slider body, a pull tab and a locking spring member.

2. Prior Art

A typical example of conventional sliders of the type described incorporates a locking spring member secured to the slider body in such a manner that a portion of the spring member can, under the control of the pull tab, move into and out of the passage of the sliding clasp fastener elements within a channel defined by and between the upper and lower shields or wings which constitute the slider body. The locking spring member is made of a resilient material, usually a stainless steel such that can provide sufficient resiliency to retain the slider in locked position against accidental displacement with respect to the fastener.

Known locking sliders however have a drawback in that when their associated fastener stringers are attached to a relatively heavy, hard article such as jeans, canvas, leather and the like, the slider is liable to get loose and forced out of its locked position under the influence of severe stresses tending to split the fastener stringers laterally apart or toss them up. This is primarily due to insufficient mechanical strength and resiliency of the locking spring member. However, the choice of stainless steel for the locking member that has sufficiently high cold rolling modulus and spring coefficient to withstand such stresses is often limited by the bending and shearing operation involved in shaping the material into a relatively small, complicated configuration. If a given strip of steel is subject to bending in a complicated manner, the strip would often become fractured during its bending.

SUMMARY OF THE INVENTION

With the above-noted difficulties of the prior art sliders in view, it is the primary object of the invention to provide an improved automatic locking slider having a locking member which is easy to bend to shape, yet highly resilient to retain the slider in locked position even under the influence of increased stresses.

According to the invention, there is provided an automatic locking slider of the class described comprising a slider body having an upper wing member and a lower wing member positioned in spaced, opposed relation and connected at one end by an integral neck portion to provide a substantially Y-shaped channel therebetween, a locking spring member formed from a strip of stainless steel and supported on said upper wing member, and a pull tab having a transversely extending trunnion pivotally disposed between said locking spring member and said upper wing member, said locking member having a first section secured to the slider body adjacent said neck portion and a second section including a locking prong movable into and out of said Y-shaped channel, said first section having a groove formed by cold press and being higher in the cold rolling modulus at an area adjacent to said groove than said second section.

The invention will be better understood from the following description taken with reference to the accompanying drawings which illustrate by way of example certain preferred embodiments which the invention may assume in practice.

DETAILED DESCRIPTION OF THE PREFERRED EMBODIMENTS

Figure 1:
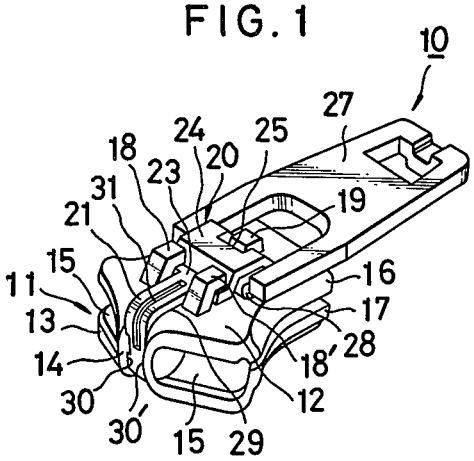
FIG. 1 is a perspective view of an automatic locking slider provided in accordance with a preferred embodiment of the invention.

Referring now to the drawings and FIG. 1 in particular, there is shown an automatic locking slider 10 constructed in accordance with the invention, the slider 10 generally comprising a slider body 11 constituted by an upper wing member 12 and a lower wing member 13 connected together at one end in spaced, opposed relation by an integral neck portion 14 to provide a substantially Y-shaped channel 15 therebetween for the passage of rows of fastener elements (not shown). Flanges 16 and 17 extend inwardly from the upper and lower wing members 12, 13, respectively and serve to retain the fastener elements in the Y-shaped channel 15 during longitudinal movement of the slider 10 along a fastener (not shown) to open or close the latter in the well known manner.

Upon the upper wing member 12 at one or forward end adjacent the neck portion 14, there are provided a pair of opposed retaining lugs 18, 18' for retaining a locking spring member, later described, in cooperation with a supporting projection 19 extending upwardly from the outer surface of the wing 12.

Figure 2:
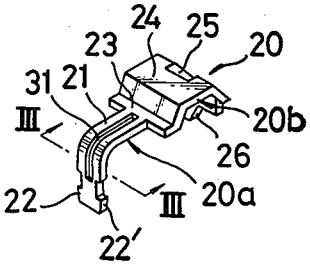
FIG. 2 is a perspective view of a locking member forming a part of the slider of FIG. 1.

A locking spring member designated at 20 and shown in particularity in FIG. 2 is operatively associated with a pull tab, later described, for releasably locking the slider 10 into position on the fastener. The locking spring member 20, which constitutes an important aspect of the invention, is made of a suitable resilient material such as stainless steel initially in the form of a blank strip, and consists of a first section **20*a* and a second section 20*b* which have different cold rolling moduli with a view to facilitating the bending or other shaping work of the blank and at the same time to affording increased resiliency and strength to a final form of locking member. The first section 20*a* is bent downwardly at substantially right angles and constitutes an arm 21 which is provided with an elongated groove 31 extending at the center and substantially throughout the length of the arm 21 and having at one end laterally projecting ears 22, 22'. The first section 20*a* is of a high cold rolling modulus at an area adjacent to the groove 31. The second section 20*b* is of a low cold rolling modulus, and is generally greater in width than the first section 20*a* or arm 21, and includes a flat seat portion 23 integral with the after end of the arm 21, a bearing portion 24 rising above the seat portion 23 for pivotally supporting a pull tab, a recess 25 formed in the back of the bearing portion 24 for receiving the supporting projection 19, and a locking prong 26 extending downwardly from the bearing portion 24 and adapted to pass through an aperture (not shown) in the upper wing 12 into the Y-shaped channel 15**.

Designated at 27 is a pull tab having a transversely extending trunnion portion 28 which is, as shown in FIG. 1, interposed between the locking spring member 20 and the outer surface of the upper wing 12 and supported within the bearing portion 24 for pivotal movement of the pull tab 27 to actuate the locking member 20 in the well known manner.

There is provided an elongated recess 29 in the outer surface of the neck portion 14, which recess is configured to conform with the contour of the arm 21 of the locking member 20 and thus adapted to receive and anchor the arm 21 or first section **20*a* therein. To further ensure retention of the arm 21, there are provided a pair of opposed cavities 30, 30' for receiving the ears 22, 22' of the locking member 20**.

The second section **20*b* of the locking member 20, which is lower in the cold rolling modulus at an area adjacent to the groove 31 than the first section 20*a*, is supported movably slightly in the vertical direction relative to the slider body, with the seat portion 23 borne against and retained by the retaining lugs 18, 18' and with the recess 25 engaged with the supporting projection 19**.

FIG. 1 illustrates the slider 10 in its locked position wherein the pull tab 27 is flipped down flat against the upper wing 12 with the locking prong 26 urged by the tension in the locking spring member 20 into the channel 15 to engage in the space between adjacent fastener elements in a manner well known. As the pull tab 27 is rotated about the trunnion 28 and lifted against the tension of the locking member 20, the locking prong 26 is pulled out of engagement with the fastener elements, whereby the slider 10 is allowed to move therealong in a direction to open or close the fastener in the well known manner.

Figure 3:
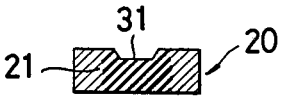
FIG. 3 is an enlarged sectional view taken on the line III—III of FIG. 2.

A preferred method of providing a locking spring member having two different cold rolling modulus sections or areas as above described, is to use a stainless steel strip of ordinary cold rolling modulus, and first bend a portion of the strip corresponding to the arm 21 or first section **20*a* to shape by cold press whereupon the pressure exerted by press creates an increase in the modulus at areas surrounding the groove 31 as shown by thickened oblique lines in FIG. 3. Thereafter, the remaining portions of the strip are bent to shape as desired. Since the arm 21 is not hardened at areas adjacent the opposite sides of the groove 31 and comparable in the cold rolling modulus to the second section 20*b*, the arm 21 can be punched out to shape easily by cutting along those unhardened areas. The locking spring member 20 may be further annealed to uniformity for enhanced spring quality. The resulting spring member 20 thus can store sufficient resiliency at the first section 20*a* or arm 21 to withstand severe stresses tending to pull the locking prong 26** out of engagement with the partner elements.

Figure 4:
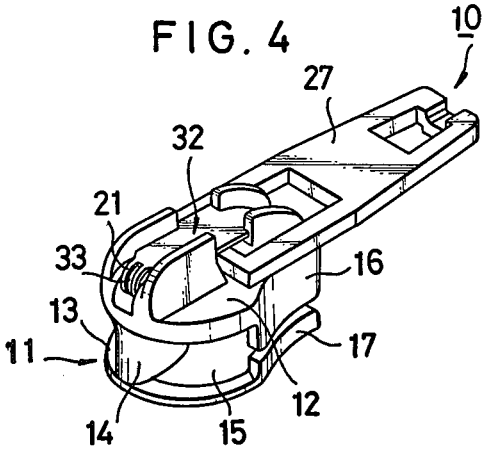
FIG. 4 is a perspective view of a modified form of slider according to the invention.
Figure 5:
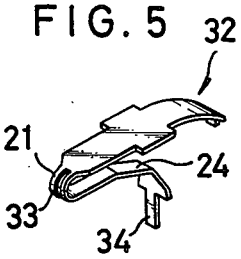
FIG. 5 is a perspective view of a locking member to be built into the slider of FIG. 4.

FIGS. 4 and 5 illustrate a modified form of slider 10 in which a locking spring member 32 is bent along a grooved portion 33 substantially into a U-shaped configuration, with an elongated locking prong 34 depending normally at substantially right angles to the plane of the slider body. Further detailed explanation of this modification will not be required, as the exact form and construction advanced herein do not constitute any positive part of the invention, the important features thereof being in the provisions of two different cold rolling modulus areas in the locking member 20, 32 for the purposes which have been described in connection with the first embodiment shown FIGS. 1, 2 and 3.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An automatic locking slider of the class described comprising a slider body having an upper wing member and a lower wing member positioned in spaced, opposed relation and connected at one end by an integral neck portion to provide a substantially Y-shaped channel therebetween, a locking spring member formed from a strip of stainless steel and supported on said upper wing member, and a pull tab having a transversely extending trunnion pivotally disposed between said locking spring member and said upper wing member, said locking member having a first section secured to the slider body adjacent said neck portion and a second section including a locking prong movable into and out of said Y-shaped channel, said first section having a groove formed by cold press and being higher in the cold rolling modulus at an area adjacent to said groove than said second section.

2. An automatic locking slider as claimed in claim 1 wherein said locking spring member is annealed.

* * * * *